US012082767B2

(12) United States Patent
Hong et al.

(10) Patent No.: US 12,082,767 B2
(45) Date of Patent: Sep. 10, 2024

(54) CLEANER APPARATUS

(71) Applicant: Samsung Electronics Co., Ltd., Suwon-si (KR)

(72) Inventors: Jimin Hong, Suwon-si (KR); Mingyu Jung, Suwon-si (KR); Kookjeong Seo, Suwon-si (KR); Jungsoo Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 403 days.

(21) Appl. No.: 17/514,569

(22) Filed: Oct. 29, 2021

(65) Prior Publication Data

US 2022/0167817 A1 Jun. 2, 2022

Related U.S. Application Data

(63) Continuation of application No. PCT/KR2021/015278, filed on Oct. 28, 2021.

(30) Foreign Application Priority Data

Nov. 27, 2020 (KR) ..... 10-2020-0162575

(51) Int. Cl.

| | |
|---|---|
| ***A47L 9/02*** | (2006.01) |
| ***A47L 5/36*** | (2006.01) |
| ***A47L 9/14*** | (2006.01) |
| ***A47L 9/16*** | (2006.01) |
| ***A47L 9/24*** | (2006.01) |
| ***A47L 9/28*** | (2006.01) |

(52) U.S. Cl.

CPC ..... *A47L 9/2889* (2013.01); *A47L 5/36* (2013.01); *A47L 9/02* (2013.01); *A47L 9/1409* (2013.01); *A47L 9/1683* (2013.01); *A47L 9/248* (2013.01)

(58) Field of Classification Search

CPC ..... A47L 9/2889; A47L 5/36; A47L 9/02; A47L 9/1409; A47L 9/1683; A47L 9/248; H05F 1/00

See application file for complete search history.

(56) References Cited

U.S. PATENT DOCUMENTS 8,806,710 B2 8/2014 Follows et al.
9,512,293 B2 12/2016 Kim
(Continued)

FOREIGN PATENT DOCUMENTS

GB 2499542 A * 8/2013 ..... A47L 9/009
JP 07-222701 A 8/1995
(Continued)

OTHER PUBLICATIONS

International Search Report dated Feb. 21, 2022, issued in International Application No. PCT/KR2021/015278.

*Primary Examiner* — David Redding
(74) *Attorney, Agent, or Firm* — Jefferson IP Law, LLP

(57) ABSTRACT

A cleaner apparatus including a filler configured to reduce static electricity is provided. The cleaner apparatus includes a main body, a dust container detachably coupled to the main body, an extension tube having an end detachably coupled to the main body, and a suction head detachably coupled to another end of the extension tube, wherein the dust container includes a first filler having a charge mobility of 16,000 to 200,000 $cm^2/Vs$ and an aspect ratio of 1:1,500 to 1:8,500.

15 Claims, 9 Drawing Sheets

(56) References Cited

U.S. PATENT DOCUMENTS

| | | | |
|---|---|---|---|
| 2017/0260358 | A1 | 9/2017 | Bosnyzk et al. |
| 2018/0194952 | A1 | 7/2018 | Garcia Miralles et al. |
| 2022/0079405 | A1 | 3/2022 | Yang et al. |

FOREIGN PATENT DOCUMENTS

| | | | |
|---|---|---|---|
| JP | 5831716 | B2 | 12/2015 |
| JP | 2018086038 | A | 6/2018 |
| KR | 10-2001-0043519 | A | 5/2001 |
| KR | 10-2011-0067372 | A | 6/2011 |
| KR | 20140105119 | A | 9/2014 |
| KR | 20180031017 | A | 3/2018 |
| KR | 10-2018-0118026 | A | 10/2018 |
| KR | 10-2072015 | B1 | 3/2020 |

* cited by examiner

ASPECT RATIO 1:1,000

( a )

ASPECT RATIO 1:5,000

( b )

ASPECT RATIO 1:10,000

( c )

CLEANER APPARATUS

CROSS-REFERENCE TO RELATED APPLICATION(S)

This application is a continuation application, claiming priority under § 365(c), of an International application No. PCT/KR2021/015278, filed on Oct. 28, 2021, which is based on and claims the benefit of a Korean patent application number 10-2020-0162575, filed on Nov. 27, 2020, in the Korean Intellectual Property Office, the disclosure of which is incorporated by reference herein in its entirety.

TECHNICAL FIELD

The disclosure relates to a cleaner apparatus. More particularly, the disclosure relates to a cleaner apparatus configured to reduce generation of static electricity.

BACKGROUND ART

In general, cleaners are home appliances that generate suction force (i.e., low air pressure) to suck up dust and air, and to filter and collect foreign materials such as the dust mixed with the air sucked up by the suction force. Furthermore, a cordless stick type (i.e., receiving power without a power cord) cleaner that obtains power using a battery is provided these days to increase mobility of the cleaner.

It is common for the cleaner to include a brush to disturb dust lying on the surface to be cleaned, such as a floor. The brush may scatter the dust on the surface to be cleaned, and the scattered dust may be sucked up by the suction force of the cleaner.

When the dust and air are sucked up, static electricity may be generated due to friction between a fluid path wall surface of the cleaner and the dust. A portion of the stick type cleaner, which comes into contact with the surface is limited to a dust suction head. As the main body is separated from the surface and the power is supplied through a battery instead of a power cord, the electric charges generated are not discharged to the outside but accumulate in the main body.

In this case, the accumulated charges may cause an electric shock due to a charge difference between the cleaner and the user, which may give an electric shock to the consumer.

The above information is presented as background information only to assist with an understanding of the disclosure. No determination has been made, and no assertion is made, as to whether any of the above might be applicable as prior art with regard to the disclosure.

DISCLOSURE

Technical Problem

Aspects of the disclosure are to address at least the above-mentioned problems and/or disadvantages and to provide at least the advantages described below. Accordingly, an aspect of the disclosure is to provide a cleaner apparatus having a filler configured to reduce static electricity to prevent an electric shock due to the static electricity.

Additional aspects will be set forth in part in the description which follows and, in part, will be apparent from the description, or may be learned by practice of the presented embodiments.

Technical Solution

In accordance with an aspect of the disclosure, a cleaner apparatus including a filler configured to reduce static electricity is provided. The cleaner apparatus includes a main body, a dust container detachably coupled to the main body, an extension tube having an end detachably coupled to the main body, and a suction head detachably coupled to another end of the extension tube, wherein the dust container includes a first filler having a charge mobility of 16,000 to 200,000 $cm^2/Vs$ and an aspect ratio of 1:1,500 to 1:8,500.

The dust container may include a filler layer including a first filler, and the filler layer may include 0.001 to 0.1 wt % of the first filler based on a weight of the filler layer.

The first filler may have an aspect ratio of 1:3,500 to 1:4,500.

The dust container may include the filler layer including the first filler, and the filler layer may include 0.01 to 0.03 wt % of the first filler based on a weight of the filler layer.

The suction head may include a second filler having a charge mobility of 16,000 to 200,000 $cm^2/Vs$ and an aspect ratio of 1:1,500 to 1:8,500.

The suction head may include the filler layer including the second filler, and the filler layer may include 0.001 to 0.1 wt % of the second filler based on a weight of the filler layer.

The second filler included in the suction head may have an aspect ratio of 1:3,500 to 1:4,500.

The suction head may include the filler layer including the second filler, and the filler layer may include 0.01 to 0.03 wt % of the second filler based on a weight of the filler layer.

The main body may include a third filler having a charge mobility of 16,000 to 200,000 $cm^2/Vs$ and an aspect ratio of 1:1,500 to 1:8,500.

The main body may include the filler layer including the third filler, and the filler layer may include 0.001 to 0.1 wt % of the third filler based on a weight of the filler layer.

The third filler included in the main body may have an aspect ratio of 1:3,500 to 1:4,500.

The main body may include the filler layer including the third filler, and the filler layer may include 0.01 to 0.03 wt % of the third filler based on a weight of the filler layer.

The extension tube may include a fourth filler having a charge mobility of 16,000 to 200,000 $cm^2/Vs$ and an aspect ratio of 1:1,500 to 1:8,500.

The extension tube may include the filler layer including the fourth filler, and the filler layer may include 0.001 to 0.1 wt % of the fourth filler based on a weight of the filler layer.

The fourth filler included in the extension tube may have an aspect ratio of 1:3,500 to 1:4,500.

The extension tube may include the filler layer including the fourth filler, and the filler layer may include 0.01 to 0.03 wt % of the fourth filler based on a weight of the filler layer.

The filler may include a graphene nanotube (GNT).

Advantageous Effects

According to an aspect of the disclosure, a filler capable of reducing static electricity may be included to prevent an electric shock from the static electricity.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

MODES OF THE INVENTION

Figure 1:
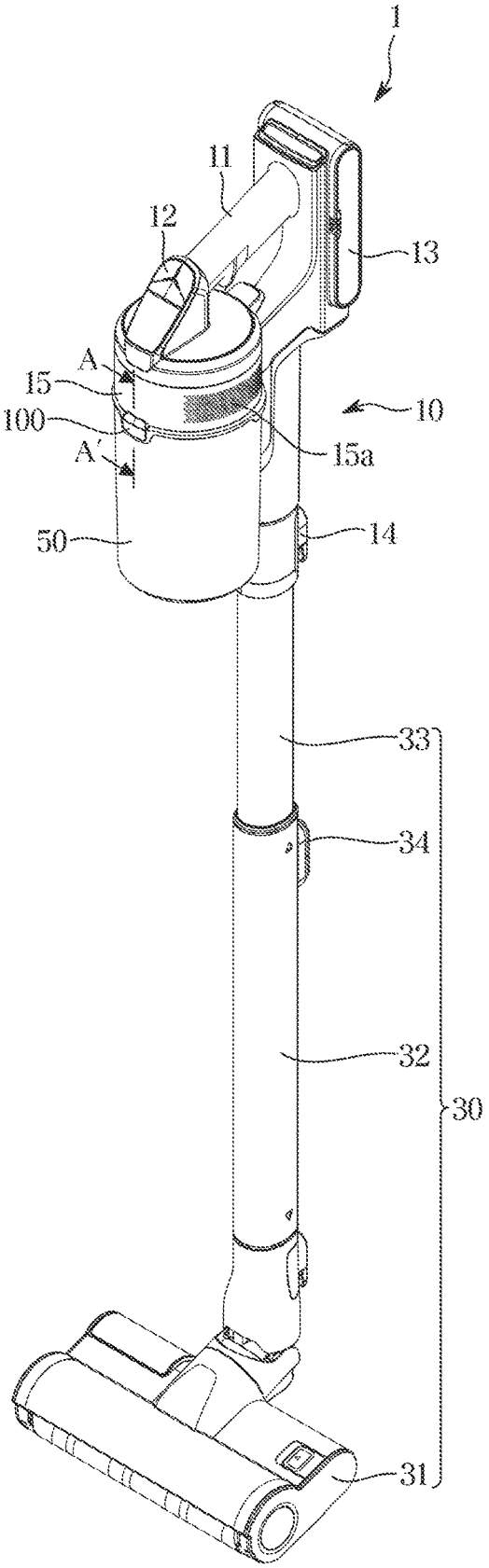
FIG. 1 is a perspective view of a cleaner apparatus, according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The term 'unit, module, member, or block' may refer to what is implemented in software or hardware, and a plurality of units, modules, members, or blocks may be integrated in one component or the unit, module, member, or block may include a plurality of components, depending on the embodiment of the disclosure.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

Throughout the specification, when it is said that a member is located "on" another member, it implies not only that the member is located adjacent to the other member but also that a third member exists between the two members.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Reference numerals used for method steps are just used for convenience of explanation, but not to limit an order of the steps. Thus, unless the context clearly dictates otherwise, the written order may be practiced otherwise.

The principle and embodiments of the disclosure will now be described with reference to accompanying drawings.

FIG. 1 is a perspective view of a cleaner apparatus, according to an embodiment of the disclosure.

Figure 2:
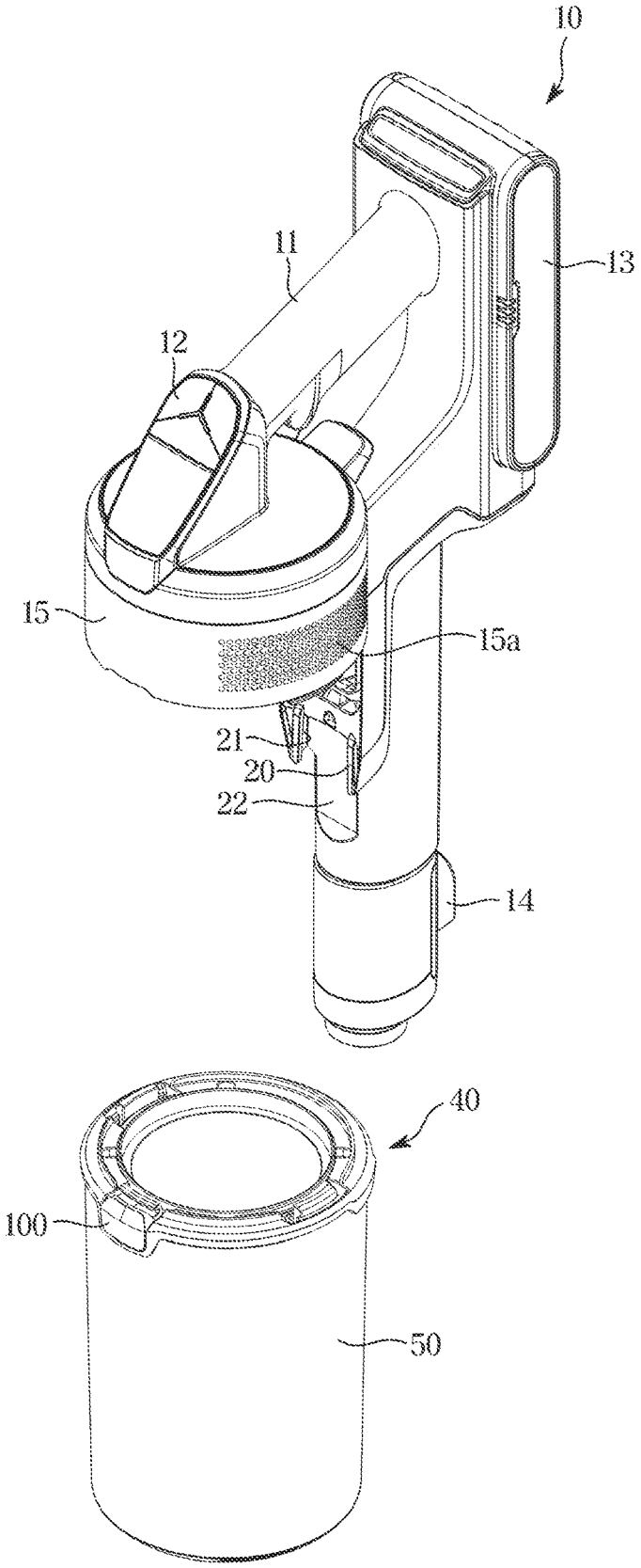
FIG. 2 illustrates a main body and a dust collector detached from the main body in a cleaner apparatus, according to an embodiment of the disclosure.

FIG. 2 illustrates some components in a cleaner apparatus separately, according to an embodiment of the disclosure.

Figure 3:
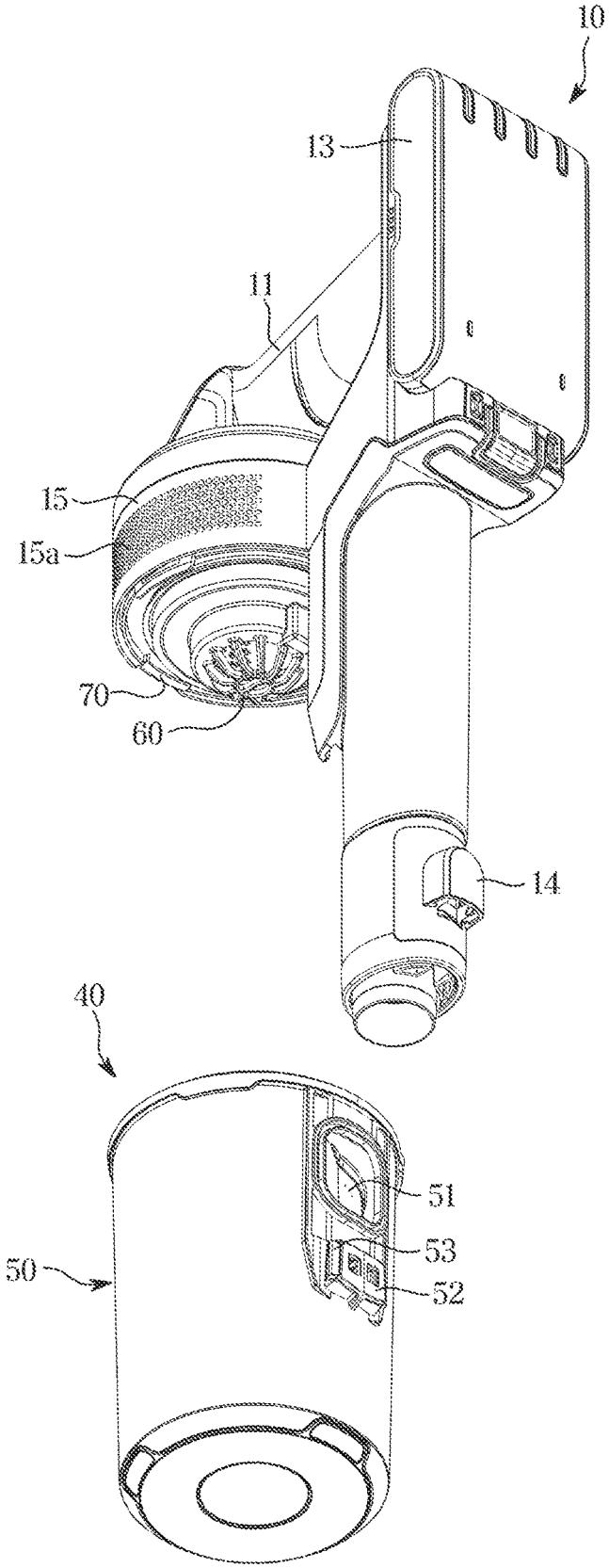
FIG. 3 illustrates the main body and the dust collector shown in FIG. 2 viewed at a different angle according to an embodiment of the disclosure.

FIG. 3 illustrates the components of the cleaner apparatus shown in FIG. 2 viewed at a different angle according to an embodiment of the disclosure.

A cleaner apparatus 1 may include a main body 10, a dust collector 40 and 50 detachably coupled to the main body 10, and a suction unit 30 detachably coupled to the main body 10.

The main body 10 may include a motor (not shown) provided to generate suction force (i.e., low air pressure). The motor may be arranged in a motor housing 60.

The dust collector 40 and 50 may be arranged farther upstream of an air flow than the motor (not shown) for separating and storing dust or foreign materials included in the air brought into a suction port 51 through the suction unit 30. The dust collector 40 and 50 may include a dust separator 40 formed to separate dust or foreign materials included in the air brought in through the suction unit 30, and a dust container 50 provided to store the dust or foreign materials separated by the dust separator 40.

Referring to FIGS. 1 to 3, the dust collector 40 and 50 may be detachably coupled to the main body 10.

The dust container 50 may include the suction port 51 provided to bring in the air sucked up by the suction unit 30. The dust container 50 may include a protrusion housing 52 and a sliding protrusion 53, which are provided to be coupled to the main body 10 by sliding or fitting.

The main body 10 may include a handle 11 to be gripped by the user to manipulate the cleaner apparatus 1. The user may grip the handle 11 and move the cleaner apparatus 1 forward or backward.

The main body 10 may include a control panel 12. The user may manipulate e.g., a power button arranged on the control panel 12 to turn on or off the cleaner apparatus 1 or control suction strength.

The main body 10 may include a battery 13. The battery 13 may be detachably coupled to the main body 10. Accordingly, after the battery 13 is used up, it may be replaced by a pre-charged battery 13, thereby extending the operation time of the cleaner apparatus 1. Alternatively, the battery 13 may be integrally formed with the main body 10.

The main body 10 may include a filter housing 15. The filter housing 15 may be formed in substantially a donut shape to receive a filter (not shown) inside. There are no limitations on the filter type, but for example, a Hepa filter may be arranged in the filter housing 15. The filter (not shown) is able to filter out e.g., ultrafine dust which is not filtered by the dust separator 40. The filter housing 15 may include a plurality of holes 15*a* to discharge the air that has passed through the filter to the outside of the cleaner apparatus 1.

The main body 10 may include a sliding rail 20, a sliding groove 21, and a guide 22, which are provided for coupling the dust collector 40 and 50 to the main body 10.

The suction unit 30 may include a suction head 31 and an extension tube 32 and 33.

The suction head 31 is provided to contact the surface to be cleaned and suck up foreign materials such as dust present on the surface.

The extension tube 32 and 33 may be arranged to connect the suction head 31 to the main body 10. An end of the extension tube may be pivotally coupled to the suction head 31. Accordingly, the suction head 31 may make articulation movements against the extension tube 32 and 33.

The extension tube 32 and 33 may include a first extension tube 32, a second extension tube 33, and a length adjuster 34. A length of the second extension tube 33 to be exposed to the outside may be adjusted by the length adjuster 34. With the length adjuster 34 adjusting the entire length of the extension tube 32 and 33, the user may choose a length of the extension tube 32 and 33 that matches his/her height.

The main body 10 may include a suction unit coupler 14. The suction unit coupler 14 may be arranged to decouple or couple the suction unit 30 from or to the main body 10. Although not shown, the cleaner apparatus may include various types of suction units, and each suction unit may be detachably coupled to the main body 10 through the suction unit coupler.

The dust separator 40 may include a button 100. The button 100 may be configured to decouple or couple the dust collector 40 and 50 from or to the main body 10 at a catch 70. In addition, the button 100 may be configured to decouple or couple the dust container 50 from or to the dust separator 40, while the dust collector 40 and 50 is decoupled from the main body 10.

In the meantime, 90% or more of the cleaner apparatuses are manufactured from plastics. Plastic is used as a main material of cleaners for moldability, weight reduction, assembly performance, manufacturing expenses, etc. However, because the plastic has insulation properties, charges produced by friction with dust are not dispersed but stay in the plastic.

A portion of the cleaner apparatus according to an embodiment of the disclosure, which comes into contact with the surface, is limited to the dust suction head 31. The main body 10 is separated from the surface, and power is supplied not through a power line but from a battery. Accordingly, the charges produced are not discharged to the outside, but accumulate in the aforementioned components of the cleaner apparatus including the dust container 50 and the main body 10.

The accumulated charges may give an electric shock caused by a charge difference between the cleaner apparatus and the user to the consumer. The electric shock refers to a shock felt by the user according to an electric potential from the static electricity charged on the human body.

In an embodiment of the disclosure, a cleaner apparatus including a filler to reduce electric charges produced by friction with dust to prevent electric shocks to the user is provided.

In general, such components of the cleaner apparatus as the dust container 50 or the main body 10 may be manufactured by injection molding using thermoplastic resin (e.g., ABS, PP, PC, PA, ABS+PC alloy, PS, etc.). In the case of plastics, by the nature of the material, electric charges may be produced by friction caused by air and dust sucked up. The electric potential from the charges produced can amount to 1 to 70 kV. The static electricity is generated by charge unbalance caused by charge movement due to friction with the other object. The friction makes it negatively charged when a negative charge is gained and positively charged when a negative charge is lost. A quantity of charge is determined by an amount of charge gained or lost.

Examining the electric potential produced by the electrostatic charges at some main components of the cleaner apparatus, a potential of 17.5 kV at the dust container, a potential of 55 kV at the suction head, a potential of 9.0 kV at the extension tube, and a potential of 5.3 kV at the main body including the handle, may be produced.

For this reason, in an embodiment of the disclosure, a filler configured to reduce the static electricity is added to at least one of the components of the cleaner apparatus such as the dust container 50, the main body 10, the suction head 31, or the extension tube 32 and 33 where the electrostatic charges are accumulated. However, as for the suction head, it comes into contact with the surface and the electrostatic charge may be discharged through the surface, but for the other components, including the dust container, at which a high electric potential is produced, addition of the filler is required to reduce static electricity, as will be described later. Furthermore, in an embodiment of the disclosure, the filler for reducing static electricity may be coated on each component of the cleaner apparatus to form a filler layer. The filler layer may include the filler and a binder, which will be described later. For the binder, a well-known type of binder may be used.

Although reduction in static electricity by applying the filler is described by taking an example of the cleaner apparatus, embodiments of the disclosure may be applied to not only the cleaner apparatus but also various products such as an air conditioner, a television, a refrigerator, etc.

In an embodiment, the filler for reducing static electricity may be defined by charge mobility ($cm^2/Vs$) related to the movement of charges produced, and an aspect ratio of the filler and an amount of filler addition related to reduction in static electricity, implementation of transparency of the component, and easiness of coloration.

In an embodiment of the disclosure, the filler added to each component of the cleaner apparatus may have a charge mobility of 16,000 to 200,000 $cm^2/Vs$ and an aspect ratio of 1:8,500, and may be added in 0.001 to 0.1 wt % based on a weight of a filler layer formed on the component to which the filler is added. In an embodiment of the disclosure, the filler may be implemented with a graphene nanotube (GNT). Fillers contained in the respective components of the cleaner apparatus, e.g., the dust container, the suction head, the main body, and the extension tube may be termed a first filler, a second filler, a third filler, and a fourth filler, but they will be collectively called the filler because the charge mobility as well as the aspect ratios and amounts of filler addition are the same.

In an embodiment of the disclosure, the charge mobility of the filler is 16,000 to 200,000 $cm^2/Vs$.

Figure 4:
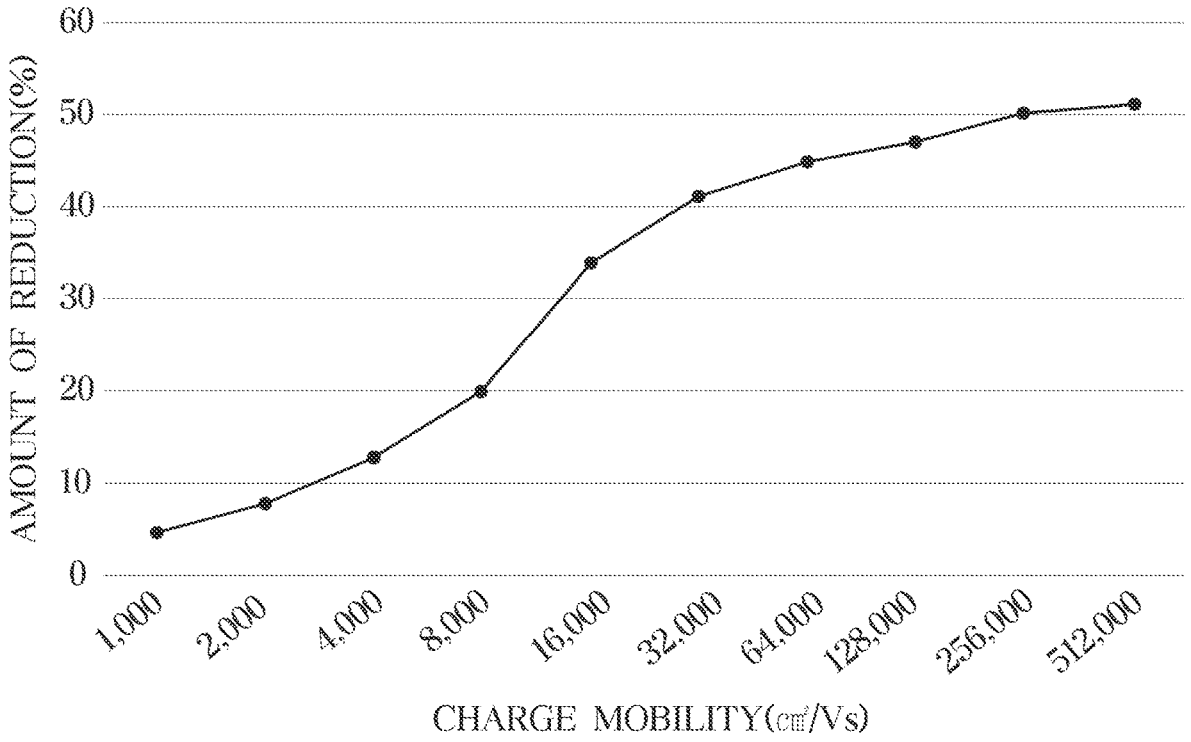
FIG. 4 is a graph representing amounts of charge reduction depending on charge mobility according to an embodiment of the disclosure.

FIG. 4 is a graph representing amounts of charge reduction depending on charge mobility according to an embodiment of the disclosure.

Charged particles such as ions, electrons, and colloidal particles move in a specific direction in a uniform electric field space. In this case, a change in magnitude of average movement speed according to a change in intensity of an external electric field is defined to be the charge mobility.

The charge mobility is a property of matter that differs depending on the type of the material, representing how fast the charge moves in the same electric field. That is, the higher the charge mobility is, the more quickly the charge moves. In an embodiment of the disclosure, the filler is required to have high charge mobility to quickly move charges to reduce or eliminate the charges in a way shown in FIG. 5, which will be described later. As an experimental result, the charge mobility needs to be 16,000 $cm^2/Vs$ or more so that the charges produced from static electricity are effectively dispersed to prevent an electric shock from being delivered to the user. In an embodiment, the filler has a charge mobility of 16,000 $cm^2/Vs$ or more. The GNT used for the filler in an embodiment of the disclosure may be manufactured in a chemical vapor deposition (CVD) method, and the GNT having a charge mobility of 16,000 $cm^2/Vs$ or more may be manufactured by controlling concentration and deposition temperature of chemicals used for the CVD based manufacturing.

In the meantime, as for materials having a charge mobility of less than 16,000 $cm^2/Vs$ such as aluminum (2,600 $cm^2/Vs$) or copper (6,000 $cm^2/Vs$), the speed for moving the charges produced was determined to be too slow to effectively disperse the electrostatic charges, which, accordingly, caused an electric shock to the user.

Referring to FIG. 4, as the charge mobility increases, it may be noted that the amount of charge reduction increases as well. The amount of charge reduction as herein used indicates a percentage of how much the amount of charges accumulated on a material is reduced as compared to an original amount of charges after a lapse of a certain time. In other words, as the amount of charge reduction increases, delivering an electric shock from the charges accumulated on the material may be reduced.

Also, referring to FIG. 4, as the charge mobility increases, the amount of charge reduction converges to about 50%. Hence, the charge mobility of the filler in an embodiment of the disclosure is determined to have 16,000 to 200,000 $cm^2/Vs$ to efficiently disperse the electrostatic charges.

In an embodiment of the disclosure, an aspect ratio of the filler is 1:1,500 to 1:8,500, and the amount of filler addition is 0.001 to 0.1 wt %.

Figure 5:
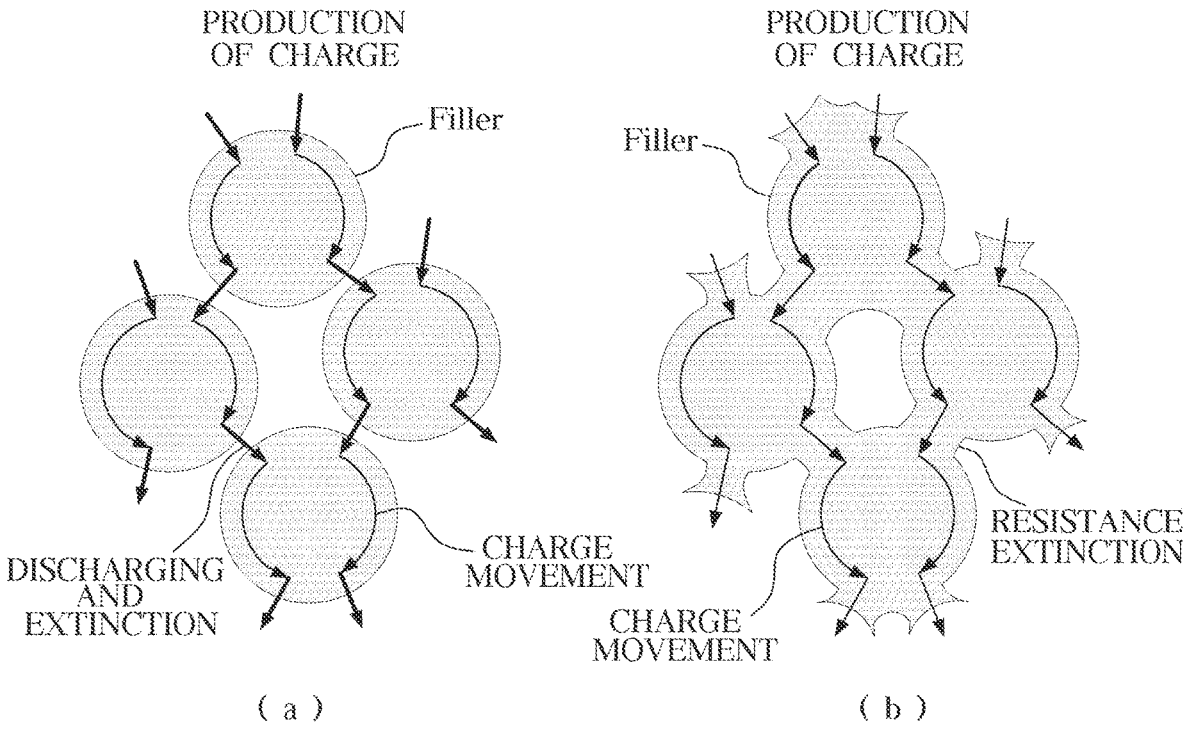
FIG. 5 is a diagram illustrating a principle by which electric charges moving along filler are reduced, according to an embodiment of the disclosure.

FIG. 5 is a diagram illustrating a principle by which electric charges moving along filler are reduced, according to an embodiment of the disclosure.

Figure 6:
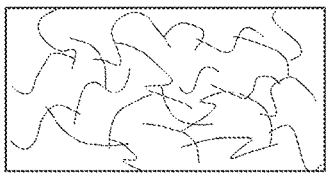
FIG. 6 is a schematic diagram illustrating amounts of filler addition and contact points between fillers, which vary according to aspect ratios according to an embodiment of the disclosure.
Figure 6:
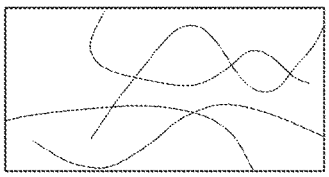
Figure 6:
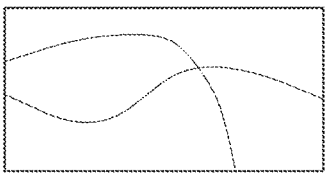

FIG. 6 is a schematic diagram illustrating amounts of filler addition and contact points between fillers, which vary according to aspect ratios according to an embodiment of the disclosure.

Figure 7:
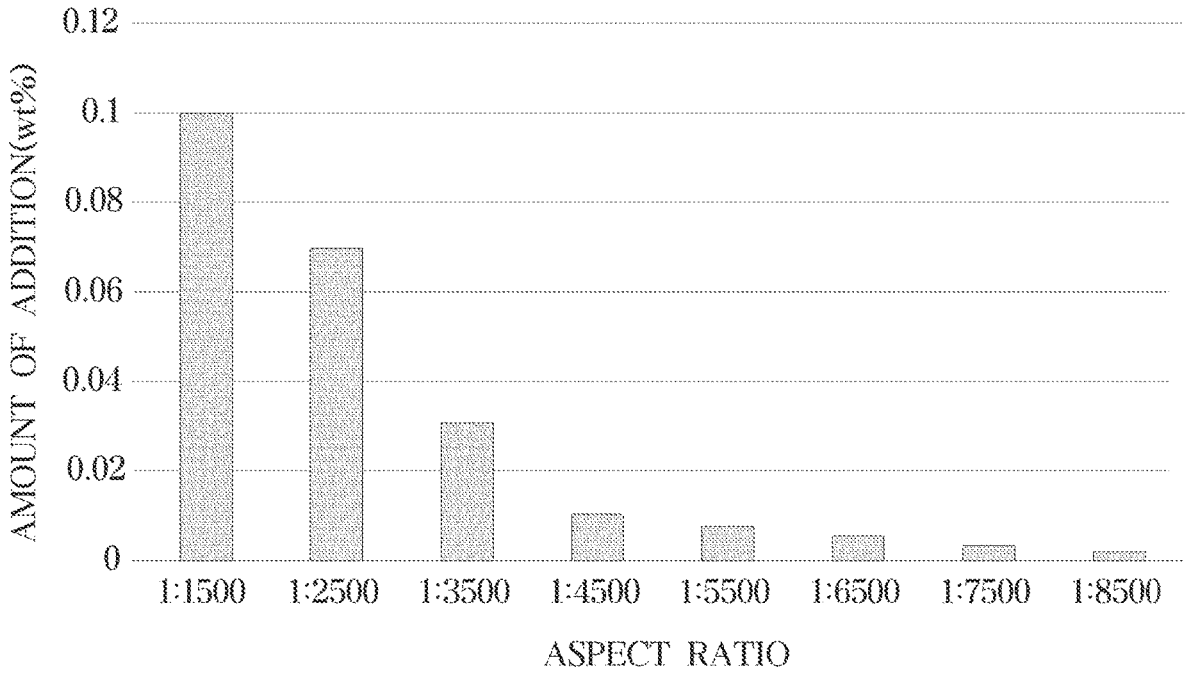
FIG. 7 is a graph representing amounts of addition varying according to aspect ratios according to an embodiment of the disclosure.

FIG. 7 is a graph representing amounts of addition varying according to aspect ratios according to an embodiment of the disclosure.

The aspect ratio indicates a ratio of diameter to length. In an embodiment of the disclosure, the aspect ratio of the filler indicates a ratio of diameter of the cross-section of a GNT to length of the GNT. Accordingly, as the aspect ratio increases, the filer has a shape in which the length increases, as shown in FIG. 6.

The charges produced by friction move along the filler with conductivity having the aforementioned charge mobility. Referring to FIG. 5, while the charges are moving, a bottleneck phenomenon of charges (see part (b) of FIG. 5) occurs at the contact point between filler and filler. Due to the bottleneck phenomenon of charges occurring at the contact point between fillers, electric energy of the charges is turned into thermal energy such as Joule heat, thereby reducing the amount of charges or removing the charges. Or, when there is a minute gap between filler and filler (see part (a) of FIG. 5), discharging occurs, so that the amount of charges is reduced or the charges dissipate.

To reduce an amount of charges or remove charges as shown in FIG. 5 by moving the charges, it is advantageous for the charges to be concentrated at contact points where fillers overlap. The fewer the number of the contact points where fillers overlap, the more the charges are concentrated at the present contact points. At the contact points at which the charges are concentrated, the greater amount of charges is reduced or removed due to the phenomenon as shown in FIG. 5.

When the aspect ratio of the filler increases, the amount of fillers for moving the charges decreases. As the filler with a high aspect ratio has a long length as shown in parts (b) and (c) of FIG. 6, the amount of fillers required to form a conductive network for continuous movement of charges is reduced. In this way, when the amount of fillers added decreases, the number of the contact points between fillers decreases as well, so that charges are concentrated at the reduced number of contact points and thus a greater amount of charges is reduced or removed. Accordingly, when the aspect ratio of the filler is high, the amount of charges may be reduced or removed only with a small amount of fillers.

On the other hand, when the aspect ratio of the filler is low, the amount of fillers for moving the charges increases. As the filler with a low aspect ratio has a short length as shown in part (a) of FIG. 6, the amount of fillers required to form a conductive network for continuous movement of charges increases. In this way, when the amount of filler addition increases, the number of contact points between fillers increases as well, so that the charges are not concentrated at a small number of contact points but dispersed to a lot of contact points. Hence, the amount of charges reduced or removed at each contact point decreases as compared to the amount of charges reduced or removed at a contact point (see parts (b) and (c) of FIG. 6) where the charges are concentrated.

In other words, the amount of charges reduced or removed at a contact point when the aspect ratio of the filler is low is less than the amount of charges reduced or removed at a contact point when the aspect ratio is high.

Accordingly, referring to FIG. 7, when the aspect ratio of the filler is low, the amount of fillers required to achieve the same effect increases. Specifically, when the aspect ratio is 1:4,500, the amount of filler addition is 0.01 wt %, but in a case that the aspect ratio decreases to 1:1,500, the amount of filler addition needs to increase to 0.1 wt % to attain reduction or removal of as many charges as those to be reduced or removed at the aspect ratio of 1:4,500.

For the aforementioned reason, when the aspect ratio of filler is less than 1:1,500, the amount of addition increases, causing problems with transparency implementation and easiness of coloration. On the other hand, the filler having an aspect ratio exceeding 1:8,500 may have a technical difficulty to be implemented. Especially, when the aspect ratio exceeds 1:8,500, the length of the filler becomes long, which leads to vulnerability of brittleness of the filler, so an upper limit of the aspect ratio of the filler may be 1:8,500. Accordingly, the aspect ratio of the filler according to an embodiment of the disclosure may be 1:1,500 to 1:8,500.

In the meantime, the filler may be implemented with the GNT as described above, and the GNT has a color of black. When the amount of filler addition exceeds a certain level, implementation of transparency of a component containing the filler becomes difficult.

For a component requiring implementation of its transparency such as the dust container 50 or the suction head 31 in particular, it is difficult to implement transparency when too many fillers implemented with the GNT are added. For example, in a case of polycarbonate used as a material for the dust container 50 of the cleaner apparatus, a visible ray penetration ratio is about 90 to 92%, which allows the dust collected in the dust container to be seen with naked eyes. Even when the filler is added to reduce the amount of electrostatic charges, a 90% or more visible ray penetration ratio of the dust container needs to be secured. However, when many GNTs are added, it is hard to secure the 90% or more visible ray penetration ratio. Furthermore, even for a component that does not require implementation of transparency such as the extension tube 32 and 33, when many fillers implemented with the black GNT are added, coloration becomes difficult and accordingly, it is difficult for the component to be implemented in a desired color.

When the amount of filler addition exceeds 0.1 wt % based on the whole weight of a component to which the filler is added, the visible ray penetration ratio of the component such as the dust container requiring transparency fails to reach 90% and coloration of a desired color is hardly implemented, so the upper limit of the amount of filler addition is set to 0.1 wt %.

Referring to FIG. 6, an aspect ratio of 1:1,500 of the filler corresponding to the upper limit of the filler addition is a lower limit of aspect ratio of the filler according to an embodiment of the disclosure. A lower limit of the amount of filler addition is related to an aspect ratio of the filler to be implemented, and as an experimental result, the aspect ratio of the filler to be implemented is 1:8,500 in consideration of time and expenses consumed for a manufacturing process of the GNT. Accordingly, the upper limit of the aspect ratio of the filler in an embodiment of the disclosure is 1:8,500, and as shown in FIG. 7, a corresponding amount of filler addition, 0.001 wt %, is the lower limit of the amount of filler addition. In other words, as transparency implementation for a component and coloration into a desired color are required, 0.001 to 0.1 wt % of filler as described above may be added in an embodiment of the disclosure.

In an embodiment of the disclosure, the filler may have an aspect ratio of 1:1.500 to 1:8,500 and 0.1 to 0.001 wt % of a corresponding amount of filler addition, for continuous charge mobility, implementation of a small number of contact points between fillers, implementation of transparency of a component, and implementation of easy coloration.

In an embodiment of the disclosure, an aspect ratio of the filler may be 1:3,500 to 1:4,500, and the amount of filler addition may be 0.01 to 0.03 wt %. For example, when the aspect ratio of the filler to be added ranges from 1:3,500 to 1:4,500, an amount of the filler to be added is limited to a range from 0.03 to 0.01 wt %. For reduction or removal of static electricity, implementation of more clear transparency and coloration of a component, and saving of the production costs of the product, the amount of filler addition may be limited to a range from 0.03 to 0.01 wt % and the aspect ratio may be limited to a range from 1:3,500 to 1:4,500 corresponding to the amount of filler addition.

In the meantime, when the cross-section of the filler is shaped more like a circle, the contact area between fillers is minimized, which may increase a rate of the bottleneck phenomenon or occurrences of discharging, thereby increasing the reduction or extinction phenomenon of static electricity.

Figure 8:
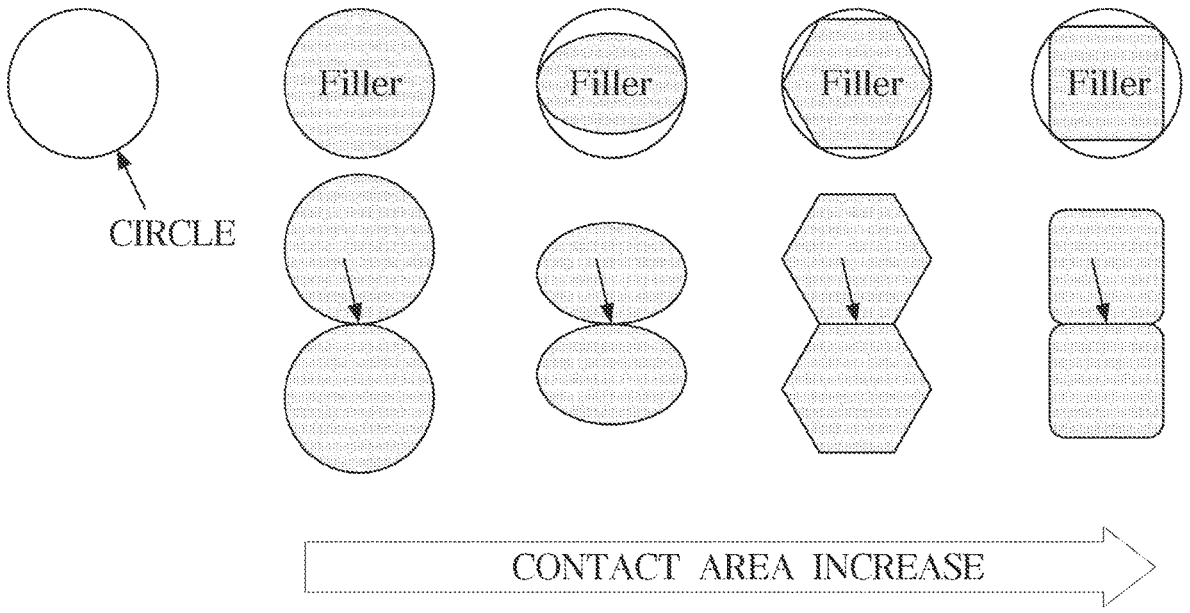
FIG. 8 conceptually illustrates aspects of contact between fillers depending on the cross-sectional shape of the filler according to an embodiment of the disclosure.

FIG. 8 conceptually illustrates aspects of contact between fillers depending on the cross-sectional shape of the filler according to an embodiment of the disclosure.

Referring to FIG. 8, when the cross-section of the filler is shaped more like a circle, a point contact is made between the fillers, and when charges move along the fillers, resistance heating and the phenomenon of electric discharge may be maximized. On the contrary, when the contact area increases, the resistance heating and the phenomenon of electric discharge are reduced, which leads to reduction of the charge extinction phenomenon. Accordingly, in an embodiment of the disclosure, the filler is provided to have a circular cross-section.

The aforementioned filler may be added in such a manner that the filler is coated on the aforementioned thermoplastic resin used to manufacture the main body 10, the suction head 31, the extension tube 32 and 33, and the dust container 50, to form a filler layer. Various well-known coating methods may be applied thereto.

An experiment was conducted to determine whether for a thermoplastic resin sample manufactured by coating the filler having the aforementioned charge mobility, aspect ratio, amount of filler addition, and cross-section form and a sample to which no filler is added, static electricity is reduced. As a result, the sample to which no filler is added produced 20 kV of charges, and the sample to which the filler is added produced 1 kV of charges.

Figure 9:
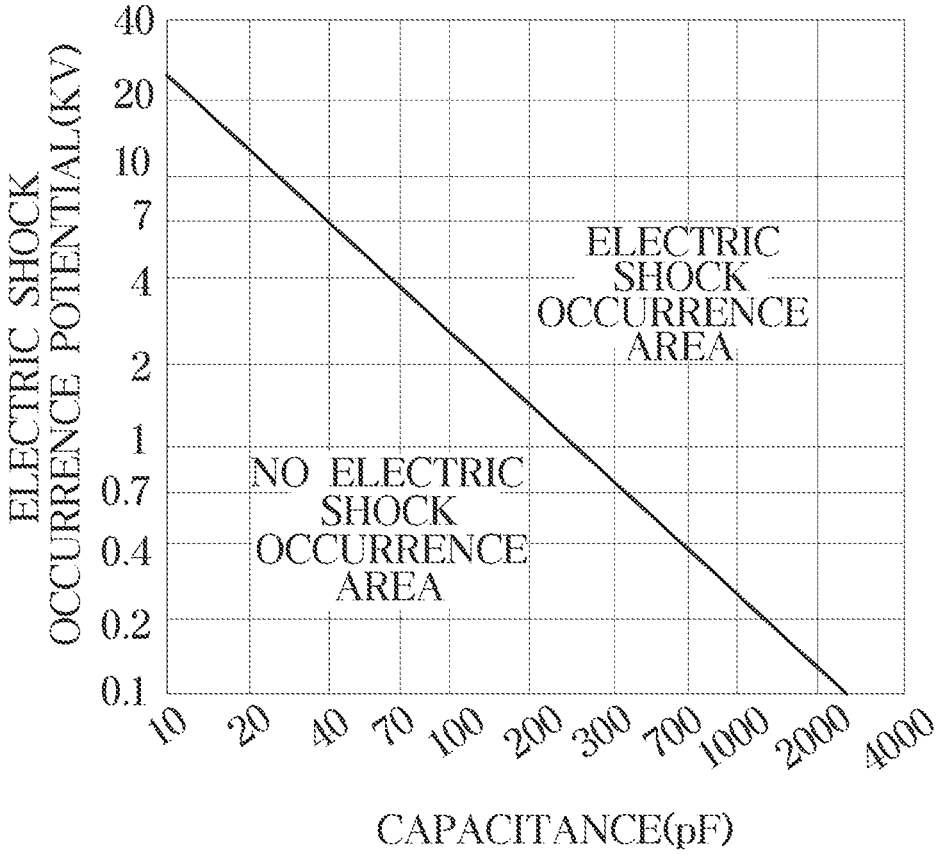
FIG. 9 is a graph representing electric shock occurrence potentials according to capacitance according to an embodiment of the disclosure.

FIG. 9 is a graph representing electric shock occurrence potentials according to capacitance according to an embodiment of the disclosure.

As human capacitance is 100 pF, referring to FIG. 9, an electric shock does not occur to the user only when 2 kV or less charge is produced. Specifically, in an embodiment of the disclosure, the sample coated with the filler produced 1 kV of charges reduced by 95% of 20 kV of the sample not coated with the filler, so it may be seen that the electric shock to the user is prevented.

While the disclosure has been shown and described with reference to various embodiments thereof, it will be understood by those skilled in the art that various changes in forms and details may be made therein without departing from the spirit and scope of the disclosure as defined by the appended claims and their equivalents.

The invention claimed is:

1. A cleaner apparatus configured to reduce accumulation of static electricity, the cleaner apparatus comprising:

a main body;

a dust container detachably coupled to the main body;

an extension tube having an end detachably coupled to the main body; and a suction head detachably coupled to another end of the extension tube, wherein the dust container comprises a first filler having a charge mobility of 16,000 to 200,000 cm'/Vs and an aspect ratio of 1:1,500 to 1:8,500.

2. The cleaner apparatus of claim 1,
wherein the dust container comprises a filler layer including the first filler, and
wherein the filler layer comprises 0.001 to 0.1 wt % of the first filler based on a weight of the filler layer.

3. The cleaner apparatus of claim 1, wherein the first filler has an aspect ratio of 1:3,500 to 1:4,500.

4. The cleaner apparatus of claim 3,
wherein the dust container comprises a filler layer including the first filler, and
wherein the filler layer comprises 0.01 to 0.03 wt % of the first filler based on a weight of the filler layer.

5. The cleaner apparatus of claim 1, wherein the suction head comprises a second filler having a charge mobility of 16,000 to 200,000 $cm^2/Vs$ and an aspect ratio of 1:1,500 to 1:8,500.

6. The cleaner apparatus of claim 5,
wherein the suction head comprises a filler layer including the second filler, and
wherein the filler layer comprises 0.001 to 0.1 wt % of the second filler based on a weight of the filler layer.

7. The cleaner apparatus of claim 5, wherein the second filler has an aspect ratio of 1:3,500 to 1:4,500.

8. The cleaner apparatus of claim 7,
wherein the suction head comprises a filler layer including the second filler, and
wherein the filler layer comprises 0.01 to 0.03 wt % of the second filler based on a weight of the filler layer.

9. The cleaner apparatus of claim 1, wherein the main body comprises a third filler having a charge mobility of 16,000 to 200,000 $cm^2/Vs$ and an aspect ratio of 1:1,500 to 1:8,500.

10. The cleaner apparatus of claim 9,
wherein the main body comprises a filler layer including the third filler, and
wherein the filler layer comprises 0.001 to 0.1 wt % of the third filler based on a weight of the filler layer.

11. The cleaner apparatus of claim 9, wherein the third filler contained in the main body has an aspect ratio of 1:3,500 to 1:4,500.

12. The cleaner apparatus of claim 11,
wherein the main body comprises a filler layer including the third filler, and
wherein the filler layer comprises 0.01 to 0.03 wt % of the third filler based on a weight of the filler layer.

13. The cleaner apparatus of claim 1, wherein the extension tube comprises a fourth filler having a charge mobility of 16,000 to 200,000 $cm^2/Vs$ and an aspect ratio of 1:1,500 to 1:8,500.

14. The cleaner apparatus of claim 13,
wherein the extension tube comprises a filler layer including the fourth filler, and
wherein the filler layer comprises 0.001 to 0.1 wt % of the fourth filler based on a weight of the filler layer.

15. The cleaner apparatus of claim 13,
wherein the fourth filler has an aspect ratio of 1:3,500 to 1:4,500,
wherein the extension tube comprises a filler layer including the fourth filler, and
wherein the filler layer comprises 0.01 to 0.03 wt % of the fourth filler based on a weight of the filler layer.

* * * * *